United States Patent [19]

Grünewälder

[11] 4,115,061

[45] Sep. 19, 1978

[54] COMBINATION METHOD FOR CLEANING GREATLY SOILED TEXTILES

[75] Inventor: Werner Grünewälder, Haan, Germany

[73] Assignee: Henkel Kommanditgesellschaft auf Aktien, Dusseldorf-Holthausen, Germany

[21] Appl. No.: 762,502

[22] Filed: Jan. 26, 1977

[30] Foreign Application Priority Data

Feb. 2, 1976 [DE] Fed. Rep. of Germany ..... 2603802

[51] Int. Cl.[2] ..... D06L 1/08; D06L 1/22

[52] U.S. Cl. ..... 8/137; 8/142; 252/162; 252/173

[58] Field of Search ..... 8/137, 142; 252/162, 252/173

[56] References Cited

U.S. PATENT DOCUMENTS

| | | | |
|---|---|---|---|
| 3,701,627 | 10/1972 | Grunewalder | 8/142 |
| 3,707,508 | 12/1972 | Blomfield | 252/162 |
| 3,907,496 | 9/1975 | Néel et al. | 8/142 |
| 3,926,831 | 12/1975 | Sonnengruber | 252/171 |
| 3,933,425 | 1/1976 | Grunewalder et al. | 8/142 |
| 4,014,805 | 3/1977 | Castrantas | 252/104 |

*Primary Examiner*—John Kight, III

*Attorney, Agent, or Firm*—Hammond & Littell

[57] ABSTRACT

A method for cleaning greatly soiled textiles with organic solvents and aqueous detergent solutions consisting essentially of (1) contacting greatly soiled textiles with a cleaning liquor consisting of a customary water-immiscible, organic dry-cleaning solvent and an aqueous solution of a detergent composition containing from 3.5% to 35% by weight of said solution of an anionic surface-active compound with a low solubility in said organic dry-cleaning solvent, wherein from 0.5 to 10 gm of said detergent composition are present per liter of said cleaning liquor for a time sufficient to clean said soiled textiles and to have said textiles absorb said aqueous solution, (2) removing the soiled organic dry-cleaning solvent from said textiles containing absorbed aqueous solution, (3) contacting said textiles containing absorbed aqueous solution with water for a time sufficient to completely wash said textiles, (4) rinsing said textiles with water, and (5) recovering said cleaned textiles.

12 Claims, No Drawings

COMBINATION METHOD FOR CLEANING GREATLY SOILED TEXTILES

RELATED ART

Greatly soiled and perspiration-stained garments, such as protective work clothes, have been cleaned heretofore by wet washing. Due to the high fat and oil content of these textiles, the sewage burden is very high in this washing method, so that the cleaning is increasingly effected by means of organic solvents. With dry-cleaning with organic solvents, the result is frequently unsatisfactory, since water-soluble stains and body odors cannot be adequately removed.

It is known to improve the cleaning effect of the organic solvents with regard to water-soluble stains by the addition of special tensides and relatively small amounts of water, where the tensides solubilize the water in the solvent or clearly dissolve it. Tenside combinations with a high water retention power have also been developed which allow the solubilization of large amounts of water in the solvent. However, in all these cases the cleaning effect of a thorough wet-washing process is not achieved.

Finally combination wet-washing and dry-cleaning methods were known where the greatly soiled textiles are contacted successively with an aqueous wash liquor and an organic solvent. In these methods, however, relatively large amounts of detergents are required, since the stubborn stains require high tenside concentrations in the aqueous liquor. Even so, the cleaning effect is still unsatisfactory.

OBJECTS OF THE INVENTION

An object of the present invention is the development of a combination dry-cleaning and wet-washing method for greatly soiled textiles by means of organic solvents and aqueous detergent solutions, whereby a particularly good cleaning effect is achieved.

Another object of the present invention is the development of a method for cleaning greatly soiled textiles with organic solvents and aqueous detergent solutions consisting essentially of (1) contacting greatly soiled textiles with a cleaning liquor consisting of a customary water-immiscible; organic dry-cleaning solvent and an aqueous solution of a detergent composition containing from 3.5 to 35% by weight of said solution of an anionic surfaceactive compound with a low solubility in said organic drycleaning solvent, wherein from 0.5 to 10 gm of said detergent composition are present per liter of said cleaning liquor for a time sufficient to clean said soiled textiles and to have said textiles absorb said aqueous solution, (2) removing the soiled organic dry-cleaning solvent from said textiles containing absorbed aqueous solution, (3) contacting said textiles containing absorbed aqueous solution with water for a time sufficient to completely wash said textiles, (4) rinsing said textiles with water, and (5) recovering said cleaned textiles.

These and other objects of the invention will become more apparent as the description thereof proceeds.

DESCRIPTION OF THE INVENTION

The subject of the invention is a method for cleaning greatly soiled textiles by means of organic solvents and aqueous detergent solutions, characterized in that the textile material is treated in a dry -cleaning plant:

(A) with a cleaning liquor consisting of an organic solvent used in dry-cleaning which is not miscible with water, and an aqueous solution of a detergent composition with a content of 3.5 to 35% by weight of an anionic surface-active compound with a low solubility in the organic solvent, using 0.5 to 10 gm of said detergent composition per liter of cleaning liquor, (B) washed again with water after the solvent has been removed, and rinsed once or several times with water.

More particularly, therefore, the present invention relates to a method for cleaning greatly soiled textiles with organic solvents and aqueous detergent solutions consisting essentially of (1) contacting greatly soiled textiles with a cleaning liquor consisting of a customary water-immiscible, organic dry-cleaning solvent and an aqueous solution of a detergent composition containing from 3.5% to 35% by weight of said solution of an anionic surfaceactive compound with a low solubility in said organic dry-cleaning solvent, wherein from 0.5 to 10 gm of said detergent composition are present per liter of said cleaning liquor for a time sufficient to clean said soiled textiles and to have said textiles absorb said aqueous solution, (2) removing the soiled organic dry-cleaning solvent from said textiles containing absorbed aqueous solution, (3) contacting said textiles containing absorbed aqueous solution with water for a time sufficient to completely wash said textiles, (4) rinsing said textiles with water, and (5) recovering said cleaned textiles.

The method of the invention employs organic solvents customarily employed in dry-cleaning, such as hydrocarbons or halogenated hydrocarbons with boiling points in the range of 23° C to 121° C, preferably alkanes and haloalkanes, for example, trichloroethylene, perchloroethylene, 1,1,1-trichloroethane, carbon tetrachloride, monofluorotrichloromethane, trifluorotrichloroethane, etc.

The anionic surface-active compounds with a low solubility in the organic dry-cleaning solvents are primarily higher hydrocarbon radicals containing sulfate, sulfonate or phosphate groups in the form of their water-soluble alkali metal salts, preferably the higher alkyl, higher hydroxyalkyl, higher alkenyl, and higher alkylbenzene sulfates, sulfonates and phosphates, for example, sulfuric acid esters of higher fatty alcohols of the chain lengths of $C_8$ to $C_{20}$, alkyl sulfonates, olefin sulfonates of the chain length of $C_8$ to $C_{35}$, alkyl sulfosuccinates with alkyl of the chain lengths of $C_8$ to $C_{20}$, alkylbenzene sulfonates with an alkyl of the chain length of $C_8$ to $C_{18}$, as well as phosphoric acid esters of higher fatty alcohols of the chain length of $C_8$ to $C_{20}$. Preferably the sodium salts of the alkyl sulfonates, olefin sulfonates and alkylbenzene sulfonates are used. The olefin sulfonates are the reaction product of $SO_3$ with an olefin. The primary reaction product is an hydroxyalkyl sulfonate with small amounts of an alkenyl sulfonate and an alkyl disulfonate.

The anionic surface-active compounds are used together with customary organic or inorganic detergent components, such as builders, sequestering agents, bleaching agents, stabilizers, soil-suspending agents and, optionally, other customary detergent ingredients, if necessary, like enzymes, optical brighteners, textile softeners, foam regulators, perfumes, etc., in the form of detergent compositions. Preferably customary all-temperature detergents are employed which correspond, for example, to the following recipe:

| | Percent by Weight |
|---|---|
| Anionic surface-active compounds | 8 to 25 |
| Sodium tripolyphosphate | 10 to 50 |
| Sodium silicate ($Na_2O:SiO_2$ = 1:1.5 to 1:3) | 3 to 20 |
| Sodium carbonate | 0 to 25 |
| Sodium sulfate | 3 to 15 |
| Carboxymethyl cellulose | 0.5 to 3 |
| Sodium perborate | 10 to 30 |
| Magnesium silicate | 0 to 4 |
| Enzymes | 0 to 1.5 |
| Optical brighteners | 0 to 0.6 |
| Sequestrants, for example, tetra-sodium ethylenediaminetetra-acetate (EDTA) | 0 to 10 |

The detergent composition is added to the organic solvent as a concentrated aqueous solution with a content of 3.5 to 35% by weight of wash-active components (the anionic surface-active compound). 0.5 to 10 gm, preferably 1 to 5 gm, of detergent is used per liter of organic solvent. Normally 10 to 100 cc of a 5 to 35% aqueous detergent solution are added per liter of the organic solvent.

The cleaning process is carried out in a dry-cleaning plant which is preferably equipped with a heatable drum housing, a dosing device, and a water feed and discharge. Before the cleaning process proper (A), which is carried out with the dry-cleaning organic solvent with the addition of the aqueous detergent solution, a precleaning with a pure solvent is advisable to remove the main portion of oily and fatty stains. The precleaning can be repeated once or several times.

After the precleaning, the cleaning drum is filled with fresh solvent and the aqueous detergent solution is added with the drum running, preferably after a few minutes (cleaning cycle A). The detergent solution can be added by hand, but preferably an automatic dosing device is used which sprays the detergent solution in desired manner through a spray nozzle onto the moving textiles or is otherwise finely distributed in the liquor, for example, through the pump recycle. The distribution of the aqueous detergent solution in the organic solvent can also be effected by adding a cleaning intensifier, such as solution aids, solvents, non-ionic and anionic tensides which are customarily employed in dry-cleaning in an amount of 1 to 8 gm/liter. Suitable tenside cleaning intensifiers are particularly alkylene oxide adducts onto higher fatty alcohols or alkyl phenols, fatty acid amides or ethanol amides, petroleum sulfonates, alkyl sulfonates, alkylbenzene sulfonates, etc.

The cleaning drum is kept moving so long until the aqueous detergent solution has been absorbed completely by the textile material, and the organic solvent has become completely clear. This is the case after a running time of about 3 to 5 minutes.

The concentrated detergent solution absorbed on the textile fibers causes an intensive soil release. Even stubborn and firmly adhering stains, which are the rule in work clothes, particularly overalls, mechanic suits, laboratory coats, aprons and coats in the food industry, hospital and operating linen, but also cleaning rags, are positively released and can be easily washed out and rinsed out in the following washing cycle with water (cleaning cycle B).

After draining off the solvent, and spinning the textile material to remove adhering solvent residues, the cleaning drum is filled with water and the textile material is washed for 15 to 30 minutes at normal and elevated temperature, washing out the detergent absorbed on the textile fiber together with the stains (cleaning cycle B). The washing or rinsing is repeated one to several times. Preferably an elevated temperature of 30° C to 100° C, particularly 60° C to 95° C, is used at least in the first wash cycle. It is advisable to use softened water. If necessary, reviving agents, finishing agents, hydrophobing agents, flameproofing agents, etc. are added to the last rinse water. After spinning and drying, perfectly clean textile goods are obtained.

The advantages achieved according to the invention consist in a considerably better cleaning effect with less greying and complete odorlessness, compared to customary dry-cleaning with cleaning intensifiers and high water dosage. Even compared to combination dry-cleaning and washing methods, where the detergent is added directly to the wash liquor, the method according to the invention permits obtaining surprisingly better cleaning effects with reduced time consumption. Compared to ordinary wet washing of greatly soiled oily or fatty textile material, such as mechanics' suits, coats used in slaughter houses, cleaning rags, the method according to the invention presents a much lesser sewage burden since the oily and fatty stains are removed to a great extent by the organic solvent. The organic solvent is regenerated by distillation, as it is customary in dry-cleaning. The cleaning effect achieved with the invention is also greatly improved, compared to wet washing.

The following examples are illustrative of the invention without being limitative in any manner.

EXAMPLE 1

(a) Method According to the Invention

In a heatable dry-cleaning plant of 9 kg capacity, equipped with water feed and discharge lines, 7 kg of soiled work clothes were cleaned in perchloroethylene for 2 minutes at 20° C with a liquor ratio of 1:8, in a precleaning step. The soiled solvent was pumped to the distillation unit and the work clothes were centrifuged for 45 seconds. Perchloroethylene was then pumped again into the drum and at the same time a solution consisting of:

50 gm Sodium dodecylbenzene sulfonate
95 gm Sodium tripolyphosphate
56 gm Sodium perborate
30 gm Sodium silicate ($Na_2O:SiO_2$ = 1:2.3)
44 gm Sodium carbonate
6 gm Carboxymethyl cellulose
840 cc Water was dosed into the suction pipe of the pump and pumped into the drum. After a cleaning time of 5 minutes, the added detergent solution had been absorbed practically completely on the textiles, and the solvent was pumped into the distillation unit. Subsequently the work clothes with absorbed detergent solution were centrifuged for 45 seconds and the drum filled with softened water. The temperature of the liquor was increased by heating to 95° C and the textile material was washed for 15 minutes at this temperature. After this, the wash liquor was drained off; the textile material was rinsed once for 5 minutes with preheated water of 60° C followed by a second rinse cycle with cold water for 5 minutes. After spinning for 2 minutes, the textiles were dried. The protective work clothes were perfectly clean and completely odorless.

(b) Known Combination Method

For comparison a second test was made in the same plant under the same conditions, but the detergent was added only at the start of the first water wash. The textiles thus cleaned were likewise odorless, but they still showed slight soil residues at the seams and borders.

(c) Known Dry-Cleaning Method

In order to permit a comparison with a conventional dry-cleaning method, 6 kg of protective work clothes were cleaned in the above-described dry-cleaning plant in perchloroethylene with a liquor ratio of 1:8 for 3 minutes at 20° C, adding 1 gm of cleaning intensifier per liter of liquor. The liquor was pumped to the distillation unit; the clothes were centrifuged for 45 minutes and cleaned again in perchloroethylene for 3 minutes with the addition of 2 gm of cleaning intensifier per liter solvent and 30% water related to the weight of the material. The liquor was pumped off. The clothes were centrifuged for 45 seconds and rinsed with clean perchloroethylene for 5 minutes with uniform filtration. This liquor was pumped back into the tank, the material was spun for 2 minutes and dried as usual.

The cleaning intensifier employed was a product of the following composition which is customary in practice:

30% by weight of an adduct of 14 mols of ethylene oxide onto nonylphenol,
15% by weight of a sodium petroleum sulfonate with 63% wash-active substance, 5% weight and 32% mineral oil,
5% by weight of water,
5% by weight of ethanol, and
45% by weight of perchloroethylene.

The cleaning effect was much poorer than in the method according to the invention. In addition, the material was not odorless.

(d) Conventional Wet Washing

In another test, 5 kg of the protective work clothes were washed in a household washing machine according to the conventional "boiling" wash program, adding a detergent according to Example 1(a). The cleaned textiles were odorless, but not as clean as with the claimed method.

In order to determine the cleaning effect, predirtied test fabrics of polyester/cotton (65/35) sold by Testfabrics, Inc., 13 Vandan St., New York, N.Y., were employed in the foregoing tests. The brightening of the stains and the greying of the unsoiled part of the fabric were determined with a reflectometer. The following values were obtained:

| Cleaning Method | Relfectometer Measurement | |
|---|---|---|
| | % Brightening | % Greying |
| a) According to invention | 57 | 10 |
| b) Conventional combination method | 53 | 11 |
| c) Conventional emulsion method | 30 | 13 |
| d) Conventional wet washing | 44 | 9 |

EXAMPLE 2

In the cleaning plant described in Example 1, 7 kg of cleaning rags were cleaned in trichloroethylene under the conditions of Example 1(*a*). As a detergent, a solution was used consisting of:

15 gm Sodium olefinsulfonate
10 gm Sodium laurylsulfate
45 gm Sodium tripolyphosphate
10 gm Sodium perborate
20 gm Sodium carbonate
11 gm Sodium silicate ($Na_2O:SiO_2$ = 1:2.5)
3 gm Carboxymethyl cellulose
1140 cc Water This detergent solution was sprayed with a spraying device into the drum. The further procedure was as described in Example 1(*a*).

The cleaning rags thus cleaned were free of fatty and water-soluble stains and had no unpleasant odor.

EXAMPLE 3

In the cleaning plant described in Example 1(*a*), 7 kg of white airplane mechanics' suits were cleaned in 1,1,1-trichloroethane under the conditions described therein. After the first solvent baths, the spun textile material was cleaned for 5 minutes with 1,1,1-trichloroethane and a solution consisting of:

20 gm Sodium dioctyl sulfosuccinate
23 gm Sodium olefinsulfonate
30 gm Sodium carbonate
11 gm Sodium silicate ($Na_2O:SiO_2$ = 1:2.3)
70 gm Sodium perborate
70 gm Sodium tripolyphosphate
1 gm White toner (optical brightener)
1 gm Carboxymethyl cellulose
4480 cc Water The suits were spun and then washed with water and rinsed as described in Example 1(*a*). The cleaned suits were perfectly clean and free of perspiration and body odors.

EXAMPLE 4

In a heatable 10 kg FHC cleaning plant (cleaning plant using fluorohydrocarbons) equipped with a water feed and discharge, 8 kg polyester/cotton (65/35) coats from a slaughter house and soiled with blood and protein stains were cleaned in trifluorotrichloroethane with a liquor ratio of 1:7 for 3 minutes at 20° C. The soiled liquor was pumped to the distillation unit. The coats were centrifuged for 30 seconds; clean solvent was drained from the tank into the drum and the coats were cleaned again for 3 minutes with simultaneous filtration. Subsequently the filter pump was shut off and an emulsion consisting of:

37 gm Sodium dodecylbenzene sulfonate
28 gm Sodium laurate
66 gm Sodium tripolyphosphate
60 gm Sodium perborate
30 gm Sodium carbonate
10 gm Sodium silicate ($Na_2O:SiO_2$ = 1:2.7)
3 gm Carboxymethyl cellulose
3 gm Proteolytic enzymes
1 gm White toner (optical brightener)
1200 cc Water
300 cc Cleaning intensifier was injected into the cleaning plant. The cleaning intensifier consisted of:

30% of an adduct of 10 mols of ethylene oxide onto nonylphenol
10% coconut fatty acid monoethanolamide
10% sodium petroleum sulfonate with 63% wash-active substance, 5% water, Balance mineral oil 20% ethylene glycol
20% trifluorotrichloroethane
10% water and served to better emulsify the aqueous detergent solution. After an additional time of 3 minutes, the aqueous solution had been absorbed practically completely on the textile fabric and the dry-cleaning liquor was pumped into the tank. Subsequently, the material was spun for one minute. The drum was then filled with softened water heated to 40° C and the temperature was increased to 60° C by heating the drum housing. At this temperature the coats were washed for 20 minutes; then the temperature was reduced to about 40° C with cold water by means of the so-called "over-run rinsing method." After this temperature was attained, the addition of water was stopped and to this rinsing liquor 2 gm of dimethyldistearyl ammonium chloride per liter were added as an antielectrostatic additive to avoid the build-up of electrostatic charges. After a treatment of 3 minutes, the liquor was drained off and the coats were centrifuged and dried as usual.

The coats cleaned this way were free of soil, blood and unpleasant odors, showed excellent whiteness and had a good antistatic effect.

The preceding specific embodiments are illustrative of the practice of the invention. It is to be understood, however, that other expedients known to those skilled in the art, or disclosed herein, may be employed without departing from the spirit of the invention or the scope of the appended claims.

I claim:

1. A method for cleaning greatly soiled textiles with organic solvents and aqueous detergent solutions consisting essentially of (1) contacting greatly soiled textiles with a cleaning liquor consisting of (A) a customary water-immiscible, organic dry-cleaning solvent and (B) an aqueous solution of a detergent composition containing from 3.5 to 35% by weight of said solution of an anionic surfaceactive compound with a low solubility in said organic dry-cleaning solvent, wherein from 0.5 to 10 gm of said detergent composition are present per liter of said cleaning liquor, for a time sufficient to clean said soiled textiles and to have said textiles substantially absorb said aqueous solution of a detergent composition, (2) removing the soiled organic dry-cleaning solvent from said textiles containing said absorbed aqueous solution of a detergent composition, (3) contacting said textiles containing said absorbed aqueous solution of a detergent composition with sufficient water at a temperature and for a time sufficient to completely wash said textiles, (4) rinsing said textiles with water, and (5) recovering said cleaned textiles,

2. The method of claim 1 wherein said customary water-immiscible dry-cleaning solvent is a halogenated hydrocarbon with a boiling point in the range of from 23° C to 121° C.

3. The method of claim 1 wherein said anionic surface-active compound with a low solubility in said organic dry-cleaning solvent is selected from the group consisting of the water-soluble alkali metal salts of higher alkyl sulfates, higher alkyl sulfonates, higher alkyl phosphates, higher alkylbenzene sulfonates, higher olefin sulfonates and di-higher alkyl sulfosuccinates.

4. The method of claim 3 wherein said salts are the sodium salts.

5. The method of claim 1 wherein said detergent composition consists of:

| | Percent by Weight |
|---|---|
| Anionic surface-active compounds | 8 to 25 |
| Sodium tripolyphosphate | 10 to 50 |
| Sodium silicate ($Na_2O:SiO_2$ = 1:1.5 to 1:3) | 3 to 20 |
| Sodium carbonate | 0 to 25 |
| Sodium sulfate | 3 to 15 |
| Carboxymethyl cellulose | 0.4 to 3 |
| Sodium perborate | 10 to 30 |
| Magnesium silicate | 0 to 4 |
| Enzymes | 0 to 1.5 |
| Optical brighteners | 0 to 0.6 |
| Organic sequestrants | 0 to 10 |

6. The method of claim 5 wherein said detergent composition is present in said aqueous solution in an amount of from 5 to 35% by weight.

7. The method of claim 1 wherein from 1 to 5 gm of said detergent composition are present per liter of said cleaning liquor.

8. The method of claim 1 wherein a cleaning intensifier customarily employed in dry-cleaning baths selected from the group of solution aids, solvents, nonionic surface-active compounds and anionic surface-active compounds is added to said organic dry-cleaning solvent in an amount of from 1 to 8 gm/liter.

9. The method of claim 1 wherein said washing step 3 is conducted at a temperature of from 30° C to 100° C.

10. The method of claim 1 wherein said washing step 3 is conducted at a temperature of from 60° C to 95° C.

11. The method of claim 1 wherein said water employed in steps 3 and 4 is softened water.

12. The method of claim 1 wherein at least one precleaning step with said organic dry-cleaning solvent alone is carried out before step 1.

* * * * *